US010316485B1

(12) United States Patent
Ness

(10) Patent No.: US 10,316,485 B1
(45) Date of Patent: Jun. 11, 2019

(54) RETAINING WALL BLOCK

(71) Applicant: Pacific Coast Building Products, Inc., Rancho Cordova, CA (US)

(72) Inventor: Jeffrey A. Ness, Oak Park Heights, MD (US)

(73) Assignee: PACIFIC COAST BUILDING PRODUCTS, INC., Rancho Cordova, CA (US)

( * ) Notice: Subject to any disclaimer, the term of this patent is extended or adjusted under 35 U.S.C. 154(b) by 0 days.

(21) Appl. No.: 16/038,043

(22) Filed: Jul. 17, 2018

(51) Int. Cl.
*E02D 29/02* (2006.01)
*E02D 5/02* (2006.01)
*E04B 2/02* (2006.01)

(52) U.S. Cl.
CPC ..... *E02D 29/025* (2013.01); *E02D 29/0233* (2013.01); *E02D 29/0266* (2013.01)

(58) Field of Classification Search
CPC ..... E02D 5/02; E02D 29/02; E02D 29/0225; E02D 29/0233; E02D 29/0241; E02D 29/0266; E04B 2/04; E04B 2/06; E04B 2/08; E04B 2/12; E04B 2/14; E04B 2/22; E04B 2/42; E04C 1/00; E04C 1/39; E04C 1/40; E04C 2/26
USPC ..... 405/280, 262, 284, 285, 286; 52/574, 52/302.4, 603, 604, 605, 606, 607, 608, 52/609, 503–505
See application file for complete search history.

(56) References Cited

U.S. PATENT DOCUMENTS 3,269,125 A * 8/1966 Moore ..... E02D 17/20 405/15
4,524,551 A * 6/1985 Scheiwiller ..... E01F 7/025 405/286
4,592,678 A * 6/1986 McNinch, Jr. ..... E02D 29/025 405/229
4,957,395 A * 9/1990 Nelson ..... E02D 29/0266 405/285
4,990,032 A * 2/1991 Smith ..... E02D 29/0233 405/273
5,044,834 A * 9/1991 Janopaul, Jr. ..... E02D 29/0241 405/262
5,161,918 A * 11/1992 Hodel ..... E02D 29/025 405/284
5,163,261 A * 11/1992 O'Neill ..... B28B 7/0079 405/284
5,178,492 A * 1/1993 Meheen ..... E02D 29/0241 405/262
RE34,314 E * 7/1993 Forsberg ..... E02D 29/025 405/286
5,257,880 A * 11/1993 Janopaul, Jr. ..... E02D 29/025 405/284

(Continued)

*Primary Examiner* — Benjamin F Fiorello
*Assistant Examiner* — Edwin J Toledo-Duran
(74) *Attorney, Agent, or Firm* — Sheppard, Mullin, Richter & Hampton LLP

(57) ABSTRACT

A retaining wall block generally comprises a block body having a front face with a plurality of support legs extending rearward therefrom, opposed first and second side surfaces, and opposed and substantially parallel upper and lower surfaces. A preferred leg spacing of side support legs allows the side legs of each successive course of blocks to rest on the side legs of the prior-laid rows, while allowing the center legs to float freely. The free-floating center leg may allow attachment of additional stabilization means to the center leg without preventing the blocks from resting directly on the course below.

11 Claims, 13 Drawing Sheets

(56) References Cited

U.S. PATENT DOCUMENTS 5,315,802 A * 5/1994 Hart ..... E04B 2/08 52/426
5,490,363 A * 2/1996 Woolford ..... B28B 7/0097 405/284
5,540,525 A * 7/1996 Miller ..... E02D 29/0225 405/284
5,567,089 A * 10/1996 Akamine ..... E02D 29/0283 405/284
5,601,384 A * 2/1997 Dawson ..... E02D 29/0266 405/284
D387,434 S * 12/1997 Dawson ..... D25/118
5,704,183 A * 1/1998 Woolford ..... B28B 7/0097 405/284
5,741,339 A * 4/1998 DuMars ..... E02D 29/0266 47/83
5,913,790 A * 6/1999 Dawson ..... A01G 9/025 405/286
5,951,210 A * 9/1999 Maguire ..... E02D 29/0225 405/284
5,975,809 A * 11/1999 Taylor ..... E02D 29/02 405/262
6,082,933 A * 7/2000 Maguire ..... E02D 29/025 405/286
6,371,700 B1 * 4/2002 Rich ..... E02D 29/025 405/284
6,615,561 B2 * 9/2003 MacDonald ..... E02D 29/0241 52/606
6,622,445 B1 * 9/2003 Shillingburg ..... E02D 29/0225 405/284
6,701,687 B1 * 3/2004 Shillingburg ..... E02D 29/0241 405/284
7,396,190 B2 * 7/2008 Price ..... E02D 29/025 405/284
7,621,095 B2 * 11/2009 Dean, Jr. ..... E04C 1/395 52/285.3
7,645,098 B1 * 1/2010 Rainey ..... E02D 17/20 405/284
7,780,141 B2 * 8/2010 Dawson ..... B28B 7/241 249/129
7,818,919 B1 * 10/2010 Maxwell-Merrill ... A01G 9/025 47/83
8,132,988 B2 * 3/2012 Dawson ..... B28B 7/241 405/286
8,297,887 B2 * 10/2012 Ness ..... B28B 7/0041 405/286
2001/0016150 A1 * 8/2001 Greenberg ..... E02D 29/0283 405/284
2001/0019684 A1 * 9/2001 Manthei ..... E02D 29/025 405/284
2002/0023403 A1 * 2/2002 Whitson ..... E02D 29/025 52/578
2002/0083657 A1 * 7/2002 Mattox ..... E02D 29/025 52/125.2
2002/0172563 A1 * 11/2002 Rainey ..... E02D 29/0225 405/284
2003/0012608 A1 * 1/2003 Race ..... E02D 29/0241 405/284
2003/0017011 A1 * 1/2003 DeVoe ..... E02D 29/025 405/284
2003/0029127 A1 * 2/2003 Tierney ..... E02D 5/10 52/831
2003/0188497 A1 * 10/2003 Price ..... E02D 27/01 52/169.12
2003/0213203 A1 * 11/2003 Bott ..... E02D 29/0241 52/603
2004/0074192 A1 * 4/2004 Mason ..... E02D 29/025 52/604
2004/0159065 A1 * 8/2004 Burgess ..... E02D 29/025 52/574
2004/0161307 A1 * 8/2004 Hammer ..... E02D 29/0216 405/284
2004/0237445 A1 * 12/2004 Kliethermes ..... E02D 29/0233 52/575
2004/0265070 A1 * 12/2004 Nanayakkara ..... E02D 29/0241 405/284
2005/0016106 A1 * 1/2005 Dawson ..... B28B 7/241 52/562
2005/0100418 A1 * 5/2005 Lee ..... E02B 3/14 405/284
2005/0252122 A1 * 11/2005 Geiger ..... B28B 17/0018 52/293.2
2005/0254906 A1 * 11/2005 Dolan ..... E02D 29/025 405/284
2005/0279046 A1 * 12/2005 Gravier ..... E02D 17/205 52/604
2006/0051166 A1 * 3/2006 Lee ..... E02D 29/0233 405/284
2006/0101770 A1 * 5/2006 Price ..... B28B 17/0018 52/605
2007/0277471 A1 * 12/2007 Gibson ..... B28B 17/0018 52/596
2008/0047218 A1 * 2/2008 Abella ..... E02D 29/025 52/600
2008/0134603 A1 * 6/2008 Henderson ..... E02D 29/0225 52/293.2
2008/0229698 A1 * 9/2008 Ulguner ..... E02D 29/0266 52/608
2008/0289283 A1 * 11/2008 Shin ..... E02D 29/0225 52/604
2008/0313988 A1 * 12/2008 MacDonald ..... E02D 29/02 52/385
2009/0208298 A1 * 8/2009 Ness ..... B28B 7/0041 405/286
2010/0251649 A1 * 10/2010 Woolbright ..... E02D 17/20 52/309.17
2010/0284751 A1 * 11/2010 Price ..... E04C 1/395 405/284
2010/0290842 A1 * 11/2010 Cho ..... E02B 3/14 405/272
2010/0303555 A1 * 12/2010 Herse ..... E04C 1/395 405/286
2011/0072753 A1 * 3/2011 MacDonald ..... E02D 29/025 52/562
2012/0057939 A1 * 3/2012 Bone ..... E02D 29/0225 405/284
2012/0063853 A1 * 3/2012 Bott ..... E02D 29/025 405/284
2012/0151862 A1 * 6/2012 Daoust ..... E04C 1/395 52/569
2013/0049259 A1 * 2/2013 Hammer ..... B28B 7/007 264/299
2013/0074436 A1 * 3/2013 Bott ..... E02D 29/025 52/568
2015/0063924 A1 * 3/2015 Brookhart ..... E02D 29/0266 405/284
2015/0308698 A1 * 10/2015 Weber ..... E04B 2/42 52/173.1
2017/0218622 A1 * 8/2017 Manthei ..... B28B 7/002
2017/0254041 A1 * 9/2017 Yu ..... E02D 17/20
2017/0260743 A1 * 9/2017 Simonson ..... E02D 29/0266
2018/0023303 A1 * 1/2018 MacDonald ..... E04F 13/0801
2018/0051436 A1 * 2/2018 Smith ..... E02D 29/025

* cited by examiner

RETAINING WALL BLOCK

BACKGROUND OF THE INVENTION

1. Field of the Invention

This invention relates generally to blocks used for the construction of retaining walls. More specifically, the invention relates to a cementitious block that is easier to place into a secure block retaining wall than existing blocks while also being able to be offer alternative methods for increasing the retaining strength of the wall made from the blocks.

2. Description of Related Art

Retaining walls made from dry stacked concrete blocks have become widely accepted for both landscaping and construction projects. These concrete blocks are mass produced, which makes them relatively inexpensive, and are available in several colors and textures. These blocks offer the durability of concrete with the attractiveness of various architectural features. Due to their significant weight, when the blocks are assembled to form a wall, they have the ability to retain soil and earth while aesthetically defining walkways, property lines, and other landscaping features. It is possible to build a wall from such blocks quickly and without the need for special skilled labor, and how quickly the wall is constructed depends on the size of the blocks used and ease of stacking the blocks for the workers.

To increase the structural integrity of the wall made from these blocks, various methods have been introduced to provide features on the blocks to interlock them together. Furthermore, walls formed from blocks that have been interlocked look more professional as the blocks are uniformly and consistently arranged. One example of an interlocking feature is a lip or protrusion extending along the lower rear edge of each block. As each successive course is laid over an underlying course, the lips of the blocks in the new course are fitted over the rear upper edge of the underlying course of blocks, which interlocks the blocks and also sets the new course back from the lower course it is resting on a predetermined distance. Another interlocking method is the use of pins extending vertically between courses of blocks to resist lateral shifting or movement between adjacent blocks and courses. Similar to the lip discussed above, pins also provide a registry function, by assuring that the front faces of the blocks are vertically aligned or setback a predetermined distance.

As the use of these concrete retaining wall blocks becomes prevalent in commercial and large-scale projects, additional soil-reinforcing materials and methods are needed to ensure that the retaining wall can prevent lateral displacement of the soil and toppling of the wall. One material that is used is a geogrid, which are commonly used to reinforce retaining walls by preventing the soils from moving by transferring the forces to a larger area of soil other than just the soil in contact with the wall. Alternatively, soil anchors or metal ribbed or wave-shaped strips can be attached to the wall and then buried in the backfilled area to provide additional strength to the retaining wall. Additionally, several of these larger commercial projects have specifications requiring engineered backfill rather than just retaining the native soil to ensure the wall maintains its integrity.

It is therefore desirable to have relatively lightweight block that allows easier and quicker installation while allowing the use of various soil-reinforcing methods and materials with increased room for more engineered backfill in contact with the individual blocks of the wall.

SUMMARY OF THE INVENTION

The present invention provides for a retaining wall block that includes a number of features making it easier to place the block into a secure block retaining wall than existing blocks while also being able to be offer alternative methods for increasing the retaining strength of the wall made from the blocks. The invention provides for a wall block generally comprising a block body having a front face with a plurality of support legs extending rearward therefrom, opposed first and second side surfaces, and opposed and substantially parallel upper and lower surfaces. The rearward extending legs of the block increase the depth of the lower surface, which provides a more stable base for the block, while also providing a reduced weight compared to a rectangle block having the same depth. Significantly lowering the weight of the concrete blocks by removing large portions of the blocks behind the front face make for much easier handling by the installer. It also saves cementitious material without compromising the strength and structural integrity of the block.

Additionally, the use of the legs to provide a stable base rather than a fully rectangular block allows more space for engineered backfill to be added to the area between the legs and behind the wall to increase drainage and stability of the retained area. In the preferred embodiment, the contour of the legs provide additional soil retaining capabilities and serve as hand holds to ease in installation. Specifically, the legs taper as they extend away from the block but terminate in a larger than the narrowed taper diameter cylinder shape. This larger termination-point shape of the legs allows the engineered backfill or soil to be compacted between the legs while also providing an anchor to help to increase the retaining strength of the blocks.

Preferably, the blocks of the present invention have three rearward extending support legs. The two side legs are not adjacent to either of the side edges of the block and are spaced an equidistance apart from the center leg. The center leg does not extend rearward from the middle of the block, but is rather offset from the middle to allow for increased manufacturing efficiency. Because the side legs are spaced equidistance apart from the center leg, which is offset, the side legs are also offset the same amount (i.e., the distance from one side leg to the side of the block nearest it is greater than the distance from the other side leg to the side of the block nearest it. The distance between the center points of the two side legs is the same as the total distance from the center point of both side legs and the respective edge of the block nearest each. This preferred leg spacing of the side legs allows the side legs of each successive course of blocks to rest on the side legs of the prior-laid rows, while allowing the center legs to float freely (i.e., not resting on the course below) as will be discussed fully below. The free-floating center leg allows for attachment of additional stabilization means to the bottom of the center leg without preventing the blocks from resting directly on the course below. The third center leg also balances the weight of the block such that the block is not front heavy, and the use of the two side legs makes the block better balanced from side-to-side than other prior art blocks. Because the weight of the block is better balanced, the block is easier to move and install and less likely to be dropped or broken during installation.

The blocks also employ a retaining pin system adapted to align and secure the blocks together. At least one retaining pin extends vertically from a bore on the upper surface of each block. Instead of relying upon a singular bore or a relatively small cavity into which the pin is to be located, longitudinal channels are provided in the bottom face of the blocks. This enables an upper block to be slid into a proper position over a lower block, where the pin in the lower block merely enters the channel in the upper block, rather than having to be located with a discrete bore or cavity. Additionally, two or more retaining pins may also be employed, for additional interlocking strength, with each pin easily being accommodated within a channel of the overlying blocks. In one embodiment, the bores and channels in the blocks are axially coincident with the center line of the block, and located an identical distance from the rear face of each block. This arrangement effects a co-planar alignment for the front faces of the blocks (i.e., the blocks form a vertical wall when interlocked). Alternatively, the upper pin bore holes may be located closer to the rear face of each block than the longitudinal channel, effecting a setback for the front face of each successively higher course of blocks.

An alternative, novel retaining pin system is provided for as well. In this embodiment, the retaining pin has a head portion and then shoulders down to a smaller diameter body section. The pin is placed in a bore that extends through the entire height of the block and shoulder of the pin rests on the shoulder of the bore to prevent the pin from falling through the bore. The head of the pin is sized so as to not protrude through the top of the block when resting on the shoulder of the bore. The body of the pin is long enough so that when resting in the block, the pin extends vertically downward from the bottom surface of the block. The downward extending portion of the pin rests behind and adjacent to the rear surface of the block in the course below, which prevents the upper block from moving forward with respect to the lower block and creates a setback for the front face of the upper block. Instead of relying upon a singular bore or a channels in the bottom face of the upper blocks that have to be aligned, this retaining pin system allows the blocks to be slid into a greater ranges of position, limited only by the distance between the rearward extending legs of the lower block. This system also allows easier installation as the upper block can be set upon the lower block and the retaining pins can be placed in the bores. Because the bottom of the upper block is resting on the top of the lower block, the pins will not be able to seat completely and extend from the bottom until the upper block is slid back into place. Once the bottom of the bore hole passes behind the top of the lower block, the pins will fall the remaining distance into place and lock the block in place.

A parapet wall block is also provided for that can be used in conjunction with the retaining wall block of the present invention to create a parapet wall. The parapet wall block generally comprises a block body having a front face, a rear face with a plurality of recesses shaped and spaced to accept the rearwardly extending support legs of the retaining wall block, opposed first and second side surfaces, and opposed and substantially parallel upper and lower surfaces. The parapet wall block has less depth than the retaining wall block, and when used in conjunction with the retaining wall blocks allows the construction of a narrower freestanding wall or fence. The preferred embodiment of the parapet wall block has a pin-receiving channel located on the upper surface to receive and engage the retaining pins used to anchor the retaining wall blocks. To construct a parapet wall, a retaining wall block is placed on a level surface, and then a parapet wall block is placed with its rearward side engaging the legs extending the rearward side of the retaining wall block. For the next course above, the parapet wall block is placed on the retaining wall block of the first course, and the retaining wall block of the second course is placed on the parapet wall block of the first course. This altering layout is used to create additional stability when coupled with the retaining pin system.

For the purposes of this application "upper" and "lower" refer to the placement of the block in a retaining wall, wherein the lower surface faces down towards the ground. To create a retaining wall, a row of blocks is placed in a first course. Subsequently, a second course is laid on top of this by positioning the lower surface of one block on the upper surface of the blocks in the first course. This process continues until the desired height of the retaining wall is achieved. The blocks of this invention are preferably made from concrete, but other suitable materials may be used. The front face of the blocks may be smooth or may have a roughened appearance to appear more like natural stone as the blocks are formed in a mold and various textures can be formed on the surface, which is known in the art.

The novel features and construction of the present invention, as well as additional objects thereof, will be understood more fully from the following description when read in connection with the accompanying drawings.

BRIEF DESCRIPTION OF THE DRAWINGS

The improved process of the invention is further described and explained in relation to the following figures of the drawings wherein.

Like reference numerals are used to describe like parts in all figures of the drawings.

DESCRIPTION OF THE PREFERRED EMBODIMENTS

Figure 1:
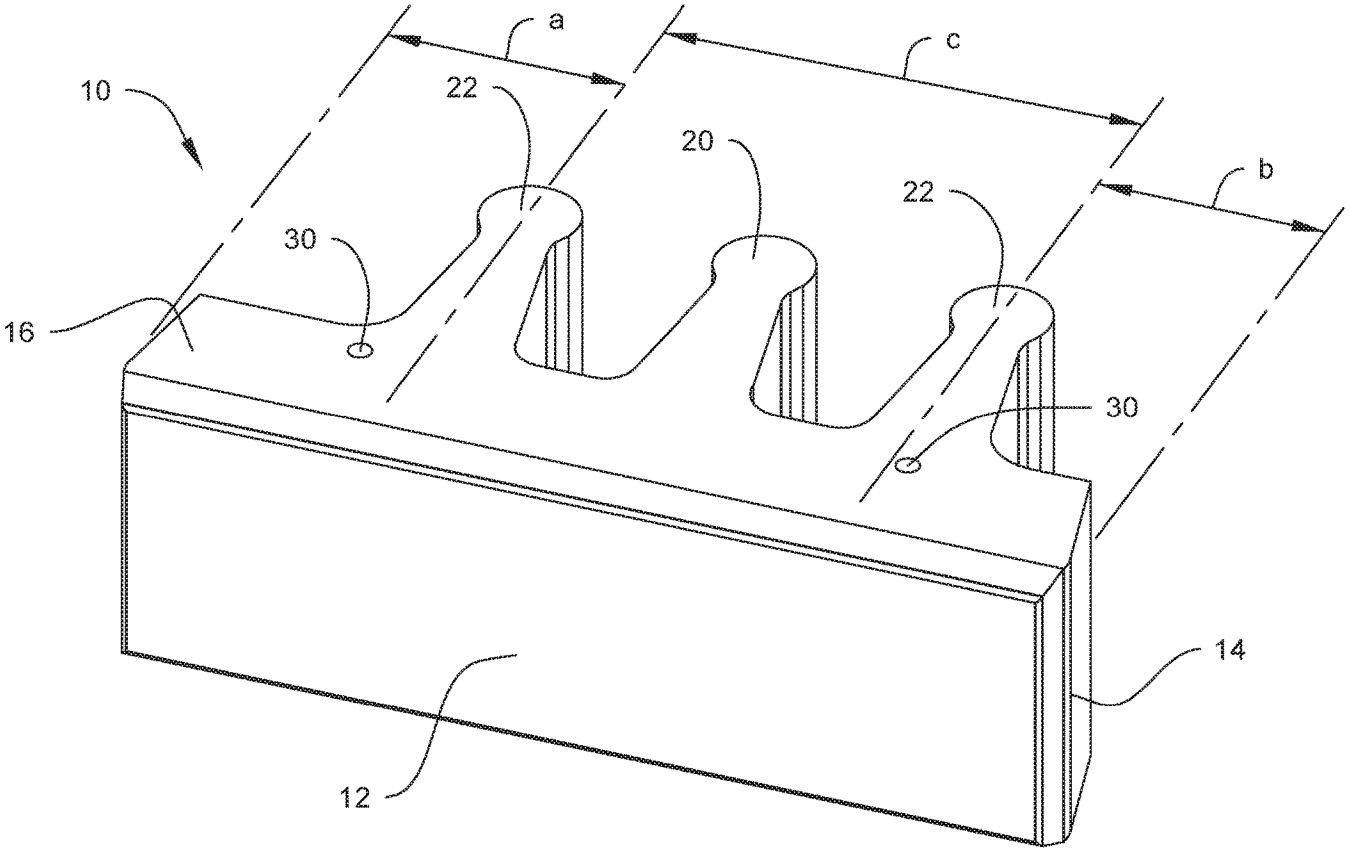
FIG. 1 is a perspective view of the upper surface of the retaining wall block of the present invention.

Referring to FIG. 1, retaining wall block 10 of the present invention is shown. Retaining wall block 10 comprises a block body having front face 12 with a plurality of support legs 20, 22 extending rearward therefrom, opposed first and second side surfaces 14 (only one side surface shown), and opposed and substantially parallel upper surface 16 and lower surface 18. Preferably first and second side surfaces 14 are tapered inward as they extend rearward from front face 12, which decreases the material needed to make block 10 and reduces the weight of block 10. When one block 10 is placed adjacent to another block 10 in the forming of a retaining wall, the edge of front face 12 and side surface 14 of one block 10 will be in contact with the edge of front face 12 and side surface 14 of the adjacent block 10, which creates a continuous rock appearance across the front of the retaining wall in both straight walls and concave walls. Due to the tapering side surfaces 14, convex walls can be built as well as the blocks 10 can be angled backwards up to the angle that the tapered side surfaces 14 of adjacent blocks 10 touch.

Rearward extending legs 20, 22 of retaining wall block 10 provide a stable base for block 10 by increasing the overall footprint depth of block 10. The use of rearward extending legs 20, 22 rather than a solid rectangular block provides a significant savings in the weight of the block and the materials necessary to form the block while still providing a significant footprint depth to increase the stability of block 10. Significantly lowering the weight of block 10 by the use of legs 20, 22 and foregoing a solid block makes block 10 much easier to handle and install. It also saves cementitious material without compromising the strength and structural integrity of block 10. Furthermore, the use of rearward extending legs 20, 22 to provide a stable base allows more space for engineered backfill to be added to the area between legs 20, 22 and behind the wall to increase drainage and stability of the retained area. Preferably, rearward extending legs 20, 22 are contoured and taper as they extend rearward from block 10 before terminating in a cylindrical shape. As shown in FIG. 1, the diameter of the cylindrical shape termination of legs 20, 22 is larger than the width of tapered legs 20, 22 at the point where the cylindrical shape termination begins. This shape of legs 20, 22 provides additional soil retaining capabilities by allowing the engineered backfill or soil to be compacted between and around legs 20, 22, while also providing an anchor to help to increase the retaining strength of block 10. The cylindrical termination of legs 20, 22 also provides a hand hold to aid the workers when moving and installing block 10.

In the preferred embodiment, block 10 of the present invention has three rearward extending support legs: center leg 20 and two side legs 22. Center leg 20 extends rearward from block 10, but not directly from the middle of block 10 as it is offset to allow for increased manufacturing efficiency, as will be discussed below and shown in FIG. 13. Side legs 22 are symmetrically spaced apart from center leg 20 and the distance between the center points of side legs 22 is defined as "c" as shown in FIG. 1. Because side legs 22 are equidistant from center leg 20, which does not extend rearwardly from the middle of block 10, the distance between left side leg 22 and left side surface 14 of block 10 is not the same as the distance between right side leg 22 and right side surface 14 of block 10. The distance between left side leg 22 and left side surface 14 is defined as "a" as shown in FIG. 1, and the distance between right side leg 22 and right side surface 14 is defined as "b" also as shown in FIG. 1. The distance between the center points of side legs 22 (or "c") is the same as the sum of the distances from the center point of both side legs 22 and the respective edges 14 nearest each (or "a" and "b"). In other words, "a"+"b"="c." This preferred leg spacing of side legs 22 allows side legs 22 of each successive course of blocks to rest on side legs 22 of the prior-laid rows, while allowing center leg 20 to float freely (i.e., not resting on the course below) as will be discussed fully below in reference to FIG. 4. Importantly, neither of side legs 22 are located adjacent to either of side surfaces 14 of block 10. Pin apertures 30 are cylindrical bores that extend through the entirety of block 10 from upper surface 16 to lower surface 18 (as shown in FIG. 2).

Figure 2:
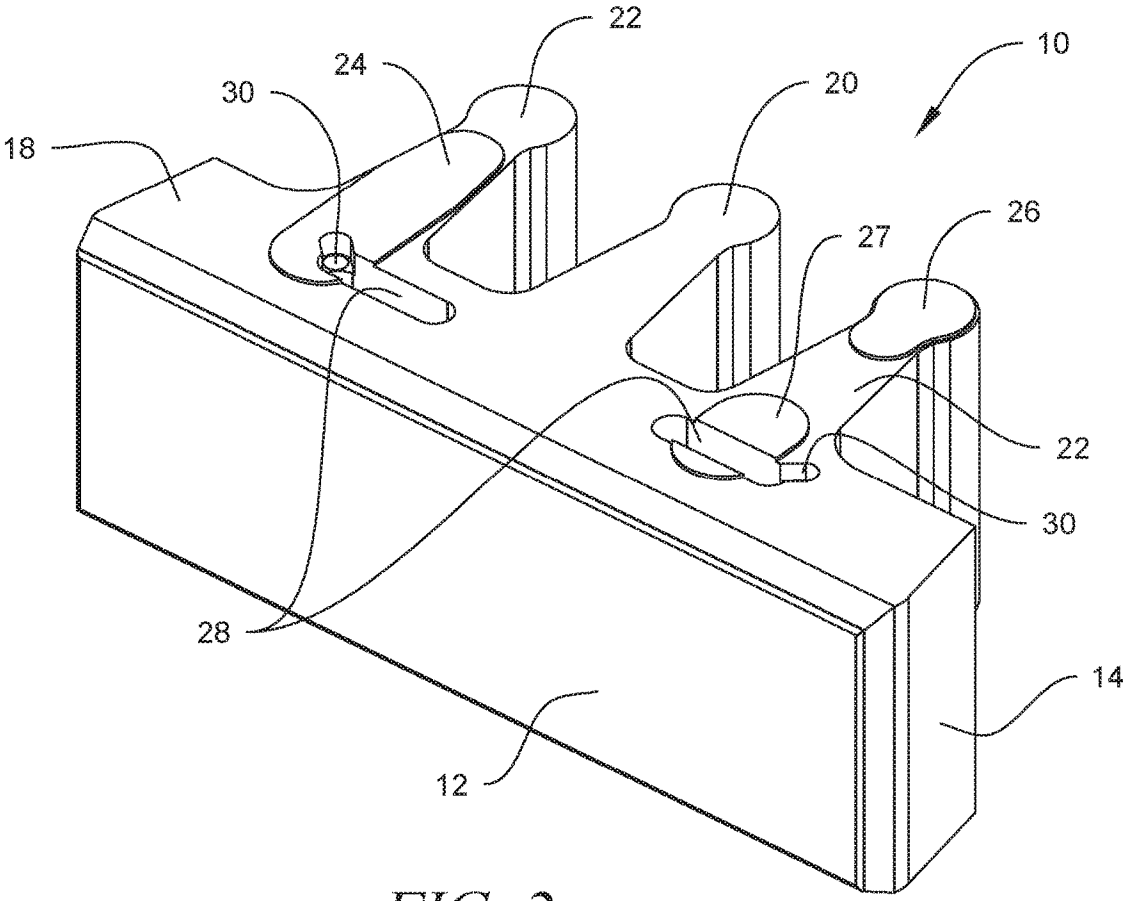
FIG. 2 is a perspective view of the lower surface with leveling pads of the retaining wall block of the present invention.

Referring to FIG. 2, the preferred embodiment of retaining wall block 10 of the present invention is shown in a position with lower surface 18 displayed. Block 10 in FIG. 2 has been is flipped upside down from the view shown in FIG. 1. Located on lower surface 18 of block 10 is are three leveling pads—large leveling pad 24 located congruent with and along one side leg 22, small leveling pad 26 is located at the termination point of opposite side leg 22, and small leveling pad 27 located on lower surface 18 in line with same side leg 22 that small leveling pad 26 is located on. Leveling pads 24, 26 and 27 are used in conjunction with each other to create a three point leveling system for block 10. Leveling pads 24, 26 and 27 are thin plateaus that extend from the surface of lower surface 18 and/or legs 22. Because leveling pads 24, 26 and 27 extend slightly from the surface of block 10, they serve as the load-bearing points for the entire block, and the entire weight of block 10 is dispersed only on the surface area of leveling pads 24, 26 and 27 rather than across the entire surface area of lower surface 18 and lower surface of legs 20, 22.

Leveling pads 24, 26 and 27 help prevent the rocking of block 10 when placed in a retaining wall on top of other courses of blocks due to any manufacturing imperfections, such as a block that is bowed or twisted. Blocks without leveling pads that are bowed or banana-shaped from side surface to side surface have a tendency to break vertically through the face of the block when placed in a wall due to the vertical forces all being concentrated in the one point at the apex of the curve. The use of leveling pads 24, 26 and 27 accounts for and corrects any slight bowing that would be present due to their extension from the surface and spreads the weight of block 10 out over leveling pads 24, 26 and 27 rather than it being concentrated in the one bowed point. Similarly, blocks that have a slight twist (i.e., where two of the four corners of the block would be floating when placed on a flat surface) tend to break diagonally through the face due to a torsion load as the weight of the blocks above put undue pressure on the floating corners. The use of leveling pads 24, 26 and 27 accounts for and corrects and slight twisting that would be present due to their extension form the surface and by spreading the weight of the block 10 out over leveling pads 24, 26 and 27. Additionally, blocks with leveling pads are capable of holding geogrid materials in place better than blocks without leveling pads due to the entire weight of the block being located in the three load-bearing points rather than dispersed across the entire bottom surface area.

Figure 3:
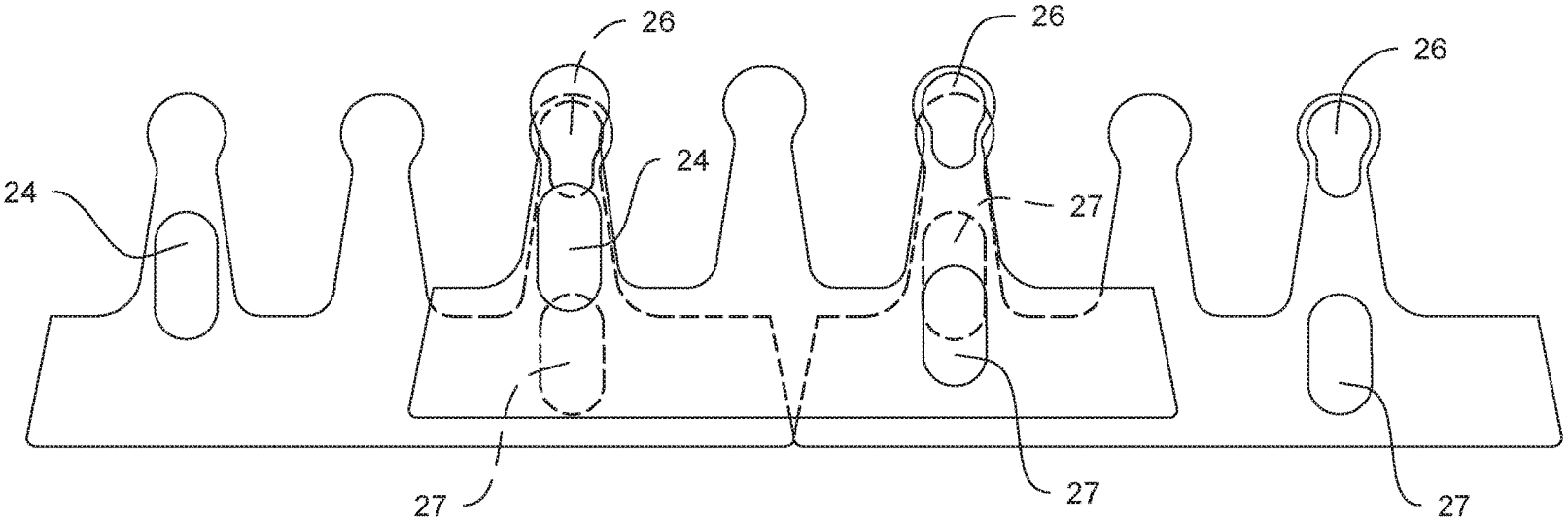
FIG. 3 is a top view of a retaining wall created with the retaining wall blocks of the present invention.

Referring to FIG. 3, a top view of a 2-course stack of blocks is shown revealing the alignment of leveling pads 24, 26 and 27 of one block in relation to other blocks. When the second course of blocks is stacked in brick formation (i.e., set where the center of the front face of the top block is aligned with the adjacent edges of the two lower blocks from the prior course), outside legs 22 align over outside legs 22 of the prior course of blocks. Because leveling pads 24, 26 and 27 are the load-bearing points of each block and overlap the leveling pads on the blocks below creating a vertical alignment, the full weight of each block to be transferred down and through the load-bearing points of the blocks below it. For example, for the top block in FIG. 3, left larger leveling pad 24 overlaps smaller leveling pads 26 and 27 of the block in the lower course of blocks. As all the weight is borne by leveling pads 24, 26 and 27, this ensures that the free-floating center leg (as will be discussed below) bears no weight.

Referring back to FIG. 2, pin apertures 30 and pin-receiving channels 28 are shown in lower surface 18 of block 10. Pin apertures 30 are cylindrical bores that extend through the entirety of block 10 from upper surface 16 (as shown in FIG. 1) to lower surface 18. Pin-receiving channels 28 are shallow, longitudinal channels that run horizontally across lower surface of block 10. In one embodiment, pins extend vertically from pin aperture 30 on upper surface 16 of block 10 and enters pin-channel 28 in an additional block that is placed in the course above. The use of pin-receiving channel 28 rather than a discrete bore or cavity enables an upper block to be slid into a proper position over a lower block and allows more side-to-side freedom in block placement.

In this embodiment, there are two pin apertures 30 and two pin-receiving channels 28 per block, and pin apertures 30 are located further away from face 12 of block 10 than pin-receiving channels 28, which effects a setback for the front face of each successively higher course of blocks equivalent to the offset distance between pin-receiving channels 28 and pin apertures 30. In an alternate embodiment of this pinning system, pin-receiving channels 28 and pin apertures 30 are not offset and are axially coincident with the center line of block 10, which creates co-planar alignment for the front faces of the blocks (i.e., the blocks form a vertical wall) when interlocked.

Figure 4:
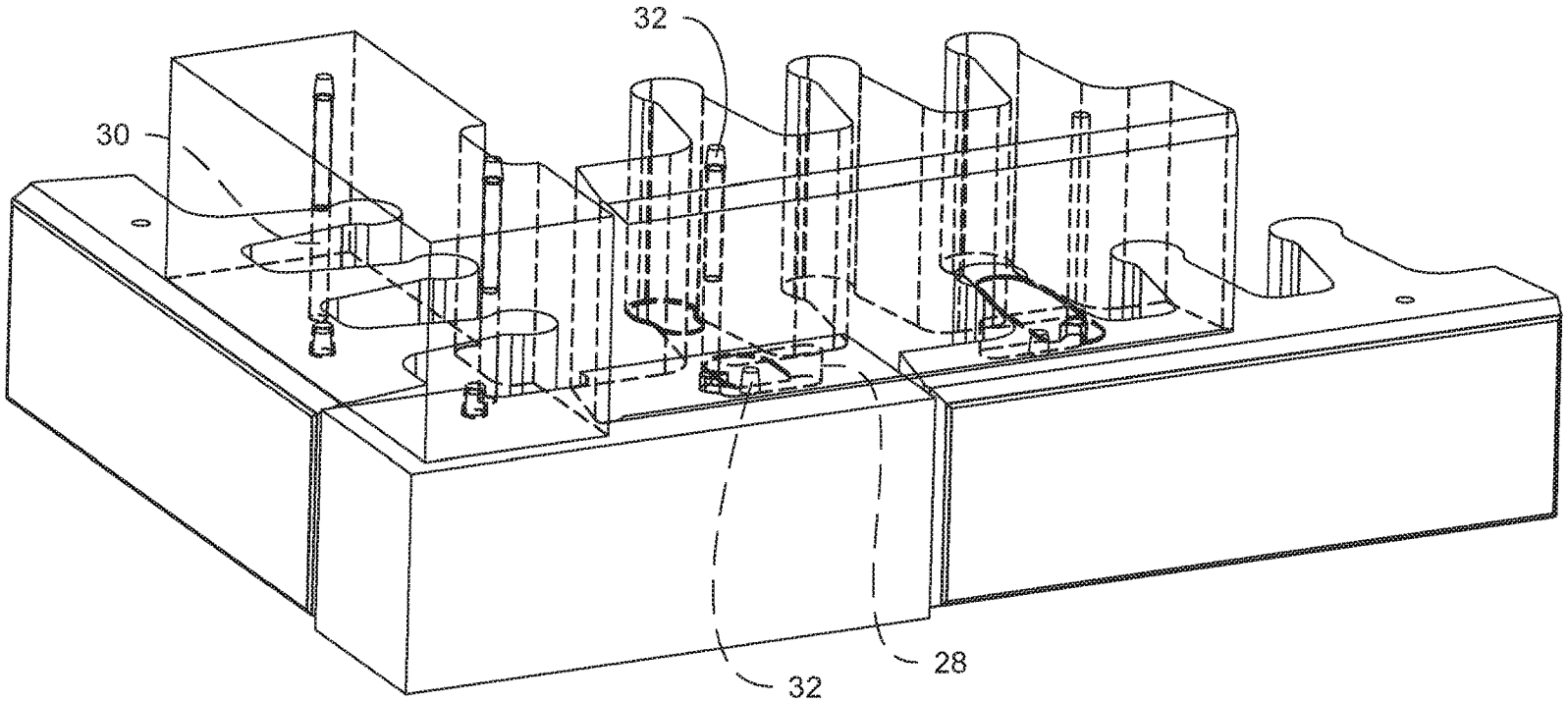
FIG. 4 is a perspective view of the front side of a retaining wall created with the retaining wall blocks of the present invention.

Referring to FIG. 4, a partial example of a two course retaining wall is shown after having the blocks interlocked with pins 32. In this embodiment, pins 32 have a larger diameter head portion that is shouldered-down to a narrower diameter body portion. Both the head portion and body portion of pins 32 are cylindrical in shape. Pin apertures 30 are large enough to accommodate the narrower diameter section of the body portion of pins 32, but not large enough to accommodate the larger diameter section of the head portion of pins 32. When pin 32 is inserted in pin aperture 30, the entire narrower diameter body portion of pin 32 is in pin aperture 30, and the shoulder of the pin between the head and body portion rests against upper surface 16 of block 10. The head portion of pin 32 therefore extends upward from upper surface 16 of block 10. When a block is installed on the wall as part of the next course, this exposed head portion of pin 32 fits into pin-receiving channel 28 in lower surface 14 of the newly placed upper block. Pin-receiving channel 28 has a width and depth sufficiently large to fit over and fully encompass the exposed head portion of pin 32. Because the body portion of pin 32 is within pin aperture 30 of a lower block and the head portion of pin 32 is within pin-receiving channel 28 of an upper block, pin 32 interlocks the upper and lower blocks together while also providing precise front-to-back alignment between the two.

Figure 5:
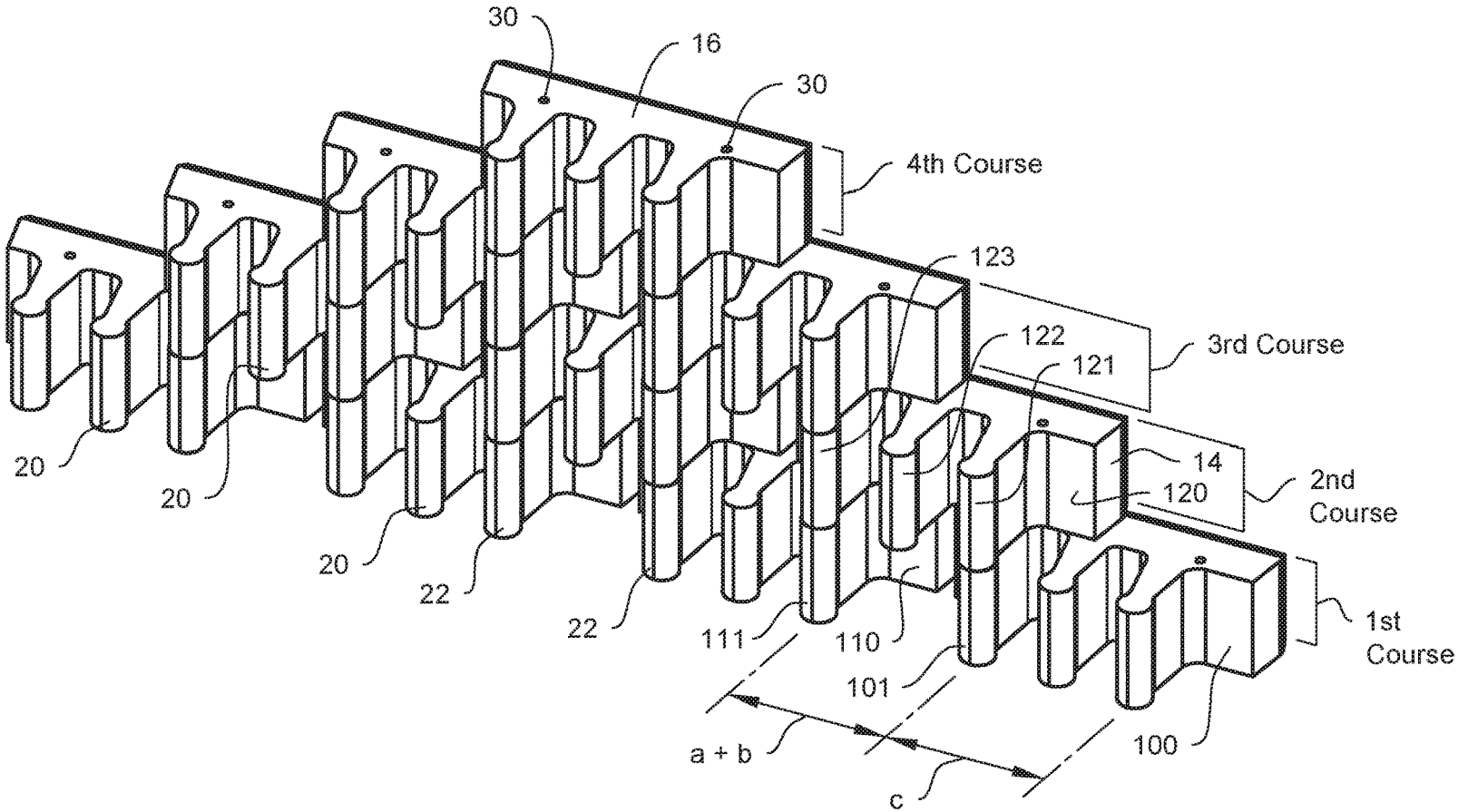
FIG. 5 is a perspective view of the of rear side of a retaining wall created with the retaining wall blocks of the present invention.

Referring to FIG. 5, a retaining wall using the retaining wall blocks of the present invention is shown. The first course of the wall (the lowest course on the bottom) is shown with four blocks placed side by side. As can be seen, when placed side by side, side legs 22 of adjacent blocks are spaced apart a distance of "a+b", which is equivalent to distance "c" that side legs 22 are spaced apart on the same block. For a specific example, block 100 is placed next to block 110 in the first course and the distance between left side leg 101 of block 100 is spaced apart a distance of "a+b" from right side leg 111 of block 110.

In general, when a second course of blocks is added on top of a first course, edge 14 of block 10 in the second course is aligned and placed in horizontal center of block 10 in the first course. This placement causes left side leg 22 of the upper block to align directly over right said leg 22 of the lower block. Specifically referring to FIG. 5, block 120 is placed half on top of block 100 and half on top of block 110. Right side leg 121 of upper block 120 is aligned with and resting on left side leg 101 of lower block 100, while left side leg 123 of upper block 120 is aligned with and resting on right side leg 111 of lower block 110. This alignment is possible because the distance between the side legs of a single block is equivalent to the distance between the adjacent side legs of adjacent blocks.

Center leg 122 of upper block 120 is free-floating and not in contact with lower blocks 100 and 110 or any portion of the first course of blocks. As the wall is built, the center legs of the blocks never come into contact with the row below. This is by design, as having a free-floating center leg allows for attachment of additional stabilization means to the bottom of the center leg without preventing the blocks from resting directly on the course below. For example, soil anchors or metal ribbed or wave-shaped strips can be attached to the underside of the center legs that are not in contact with the other blocks and then buried in the back-filled area to provide additional strength to the retaining wall. Additionally, due to the cylindrical-shaped termination points of rearward extending legs 20, 22, other wall and soil stabilization means can be attached that have an open socket shape that would slide down and fit around the cylindrical-shaped termination points. For example, concrete trunk blocks could be sized to run from the center leg of a block on one wall to a center leg of a block on an adjacent perpendicular wall (i.e., to stabilize a wall with a right angle corner). Alternatively, a "dead man" with an open socket shape could be slid over a cylindrical termination point of a leg and then buried in the backfilled area to provide additional strength.

Figure 6:
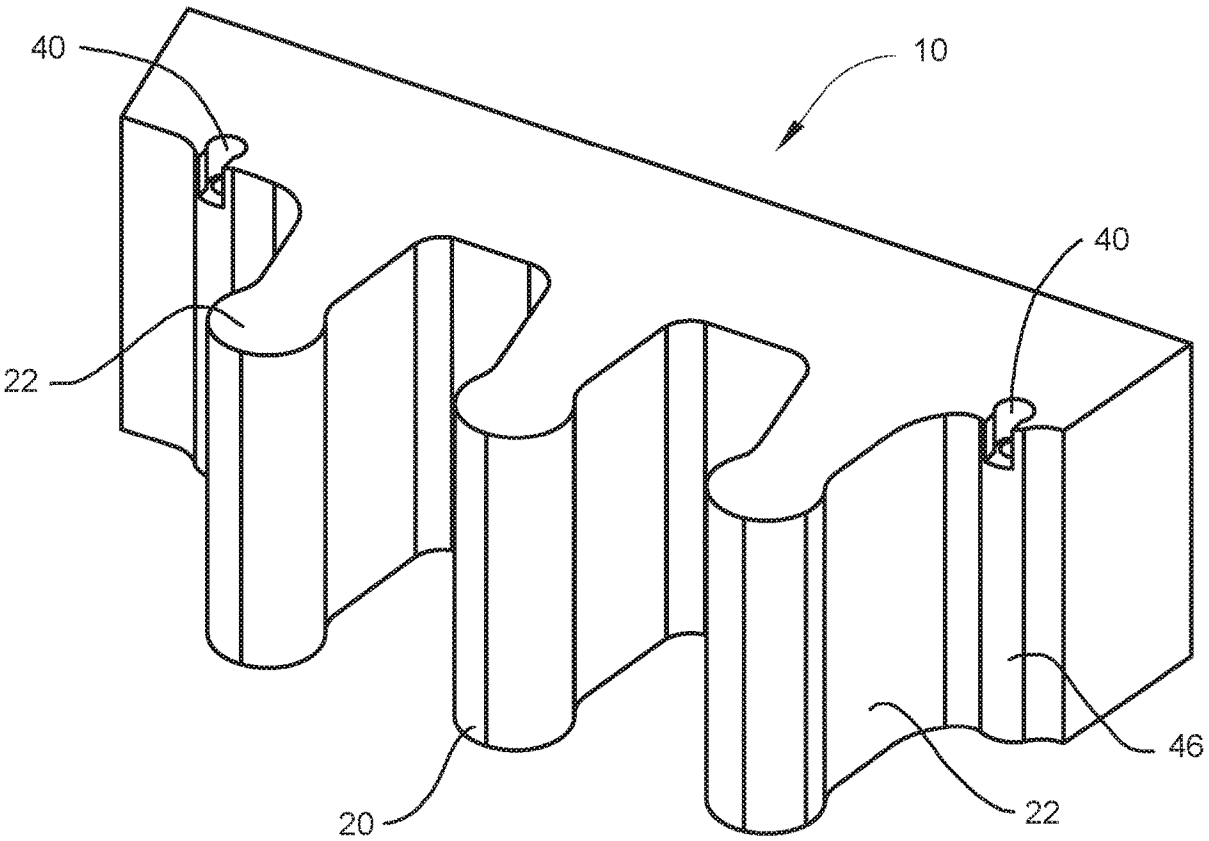
FIG. 6 is a perspective view of the rear side of the retaining wall block of the present invention for use with an alternate retaining pin system.
Figure 7B:
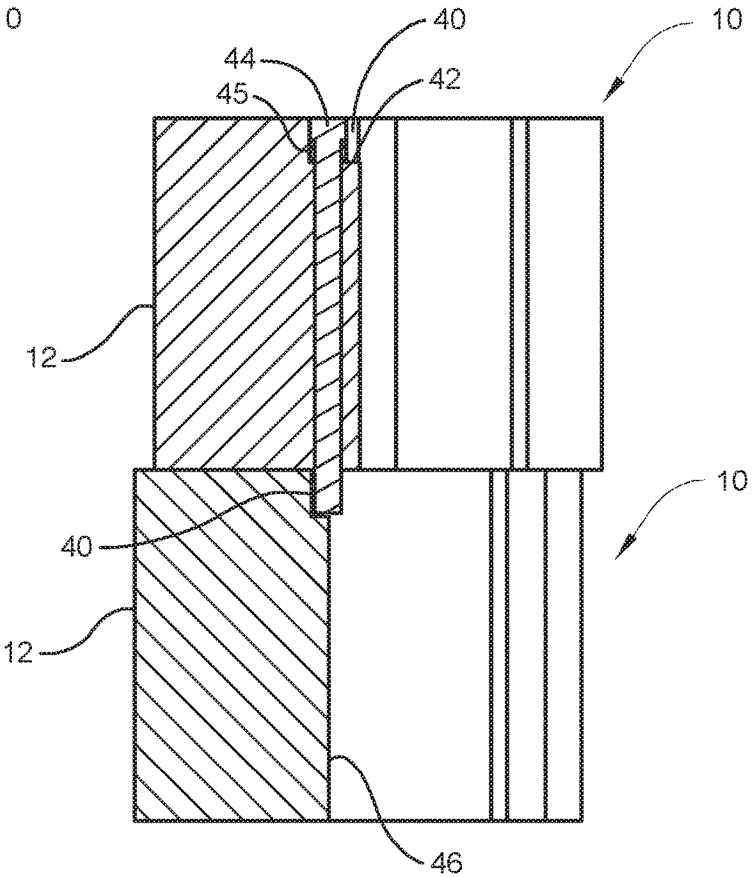
FIG. 7B is a side view of the retaining wall block of the present invention for use with an alternate retaining pin system.
Figure 7A:
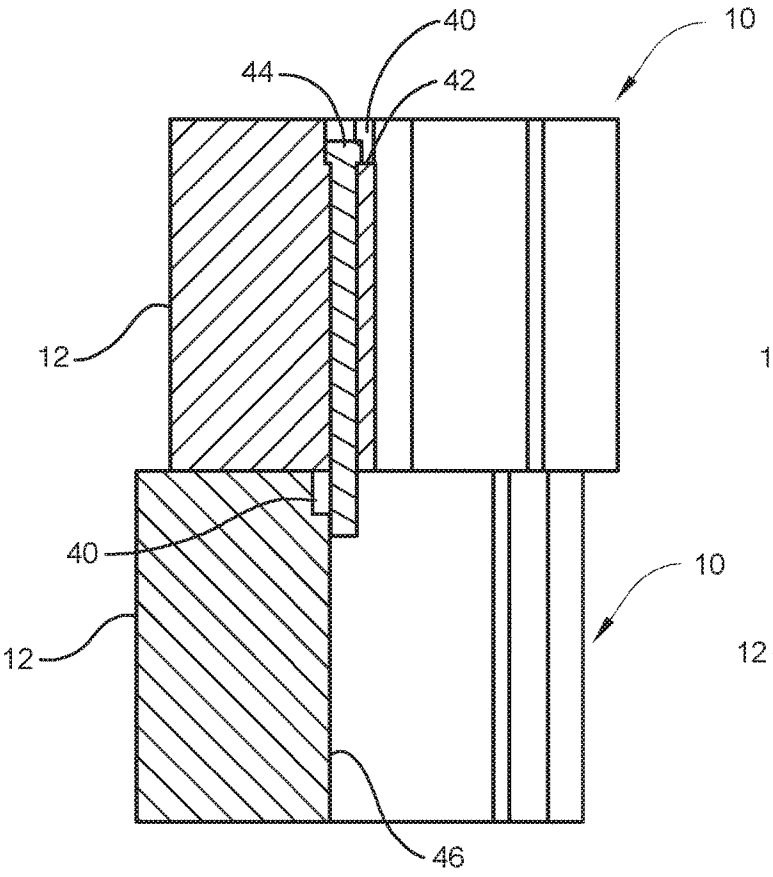
FIG. 7A is a side view of the retaining wall block of the present invention for use with an alternate retaining pin system.

Referring to FIG. 6, an alternative, novel pin-retaining system is shown. In this embodiment, block 10 has pin receiving bores 40 that are located outside of side legs 22. Pin receiving bores 40 have a larger diameter opening on the upper side of block 10, and then shoulder down to a narrower diameter bore that extends entirely through block 10. This larger diameter opening on the upper side of the block affords the opportunity to use the same retaining pins with the same blocks and alternate the set back distance of the upper block. Referring to FIGS. 7A and 7B, a side view of two course of a wall built with blocks 10 and locked in place with this novel pin-retaining system is shown with front face 12 of each block 10 on the left of both figures. FIG. 7A shows blocks 10 with a larger setback, and FIG. 7B shows blocks 10 with a smaller setback.

Referring specifically to FIG. 7A, pin 44, which has a larger diameter head portion before shouldering down to a narrower diameter body portion, is placed in bore 40 of block 10 in the upper course. As can be seen, bore 40 extends through the entire height of block 10 and the shoulder of the pin rests on shoulder 42 of bore 40 to prevent the pin from falling through bore 40. The head of the pin is sized so as to not protrude out of the top of block 10 when resting on shoulder 42 of bore 40. The narrower diameter body portion of pin 44 is sized to be long enough so that when on should 42 of bore 40 in block 10, pin 44 extends vertically downward from the bottom surface of block 10. The portion of pin 44 that extends downward from block 10 in the upper course rests behind and adjacent to rear surface 46 of block 10 in the lower course, which prevents block 10 in the upper course from moving forward with respect to block 10 in the lower course and creates a setback for front face 12 of block 10 in the upper course.

Referring specifically to FIG. 7B, washer 45 is placed onto pin 44 below the larger diameter head, and pin 44 is placed in bore 40 of block 10 in the upper course. As can be seen, washer 45 rests on shoulder 42 of bore 40 to prevent the pin from falling through bore 40, which effectively reduces the length of pin 44 extending vertically downward from the bottom surface of block 10. Washer 45 is sized so as to not make the head of pin 44 protrude out of the top of block 10 when washer 45 is resting on shoulder 42 of bore 40. The portion of pin 44 that extends downward from block 10 in the upper course rests in the larger diameter opening on the upper side of lower block 10 in the lower course, which prevents block 10 in the upper course from moving forward with respect to block 10 in the lower course and creates a setback for front face 12 of block 10 in the upper course. Because pin 44 in the upper block 10 is resting in the larger diameter opening of the upper side of lower block 10 rather than against rear surface 46 as in FIG. 7A, upper block 10 sets forward in FIG. 7B than upper block 10 in FIG. 7A. This setback variability allows the wall to be constructed with greater design flexibility using the same blocks and same pins.

Figure 8:
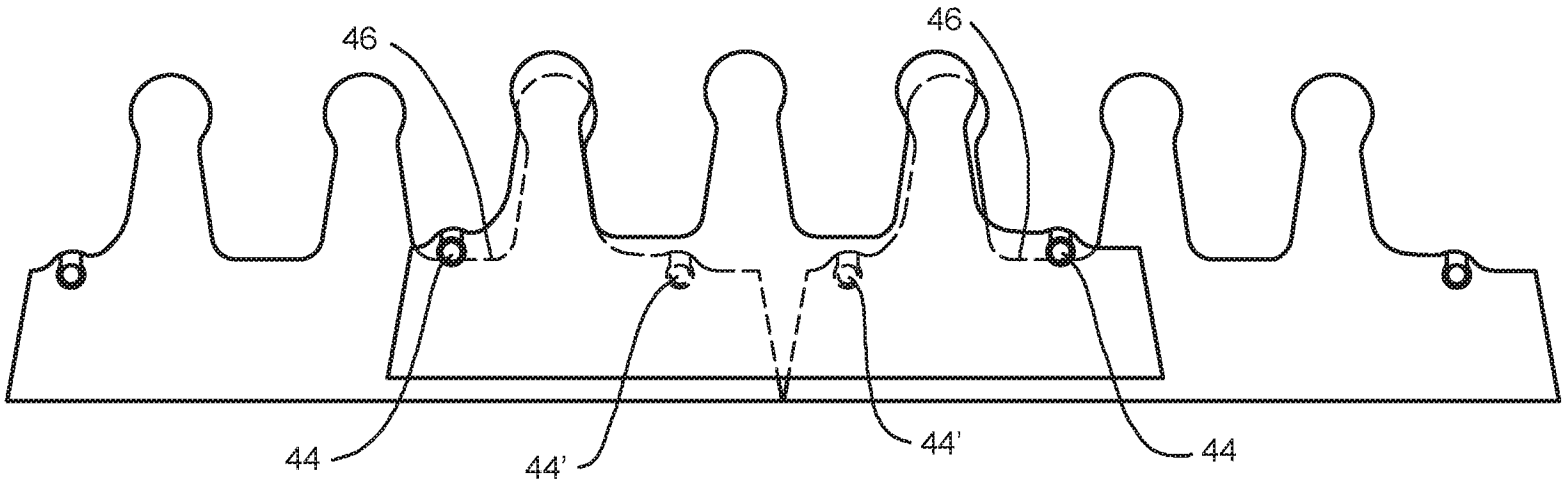
FIG. 8 is a top view of the retaining wall block of the present invention for use with an alternate retaining pin system.

Referring to FIG. 8, a top view of a 2-course stack of blocks is shown revealing the placement of pins 44 in the novel pin-retaining system. When the second course of blocks is stacked in brick formation (i.e., set where the center of the front face of the top block is aligned with the adjacent edges of the two lower blocks from the prior course), outside legs 22 align over outside legs 22 of the prior course of blocks. Pins 44 extend through bore 40 (as shown in FIG. 7A) outwardly below the block in the upper course. Pins 44 are shown resting against back surface 46 of the blocks in the lower course. Further, the block in the upper course is covering pins 44' that were inserted in the blocks of the lower course, which is possible because pins 44 (and 44') in this novel pin-retaining system do not extend outwardly from the top surface of the blocks.

As can be seen in FIG. 8, instead of relying upon a singular bore or channels in the bottom face of the upper blocks that have to be aligned, this pin-retaining system allows the blocks to be slid into a greater ranges of position, limited only by the distance between rearward extending legs 20 and 22 of the blocks in the lower course. This system also allows easier installation as the upper block can be set upon the lower block, and then retaining pins 44 can be placed in bores 40. Because the bottom of the upper block is resting on the top of the lower block, pins 44 will not be able to seat completely and extend from the bottom until the upper block is slid back into place. Once the bottom of the bore hole passes behind the top of the block in the lower course, pins 44 will fall the remaining distance into place and lock the block in place.

Figure 9:
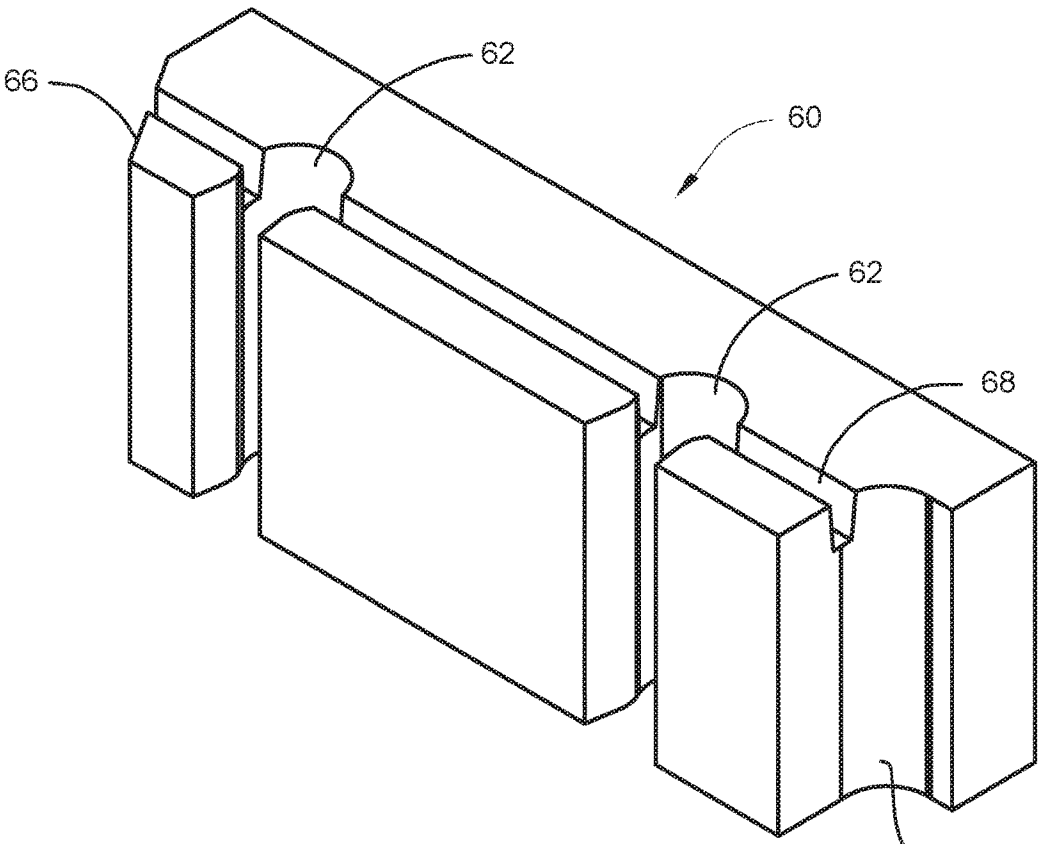
FIG. 9 is a perspective view of the rear side of a parapet wall block for use in conjunction with the wall block of the present invention.

Referring to FIG. 9, parapet wall block 60 is shown from the rear face side. Parapet wall block 60 generally comprises a block body having a front face, a rear face with a plurality of recesses 62, which are shaped and spaced to accept the rearwardly extending support legs 20 and 22 as shown in FIG. 1 of retaining wall block 10. Parapet wall block 10 also has opposed first and second side surfaces, and opposed and substantially parallel upper and lower surfaces. Side surface 66 extends rearward from the front face and then tapers back at a relatively straight angle. Side surface 64 extends rearward from the front face and then curves back with a radius towards the rear face of parapet block 60. In a preferred embodiment, parapet wall block 60 has pin-receiving channel located on the upper surface to receive and engage the retaining pins used to anchor the retaining wall blocks.

Figure 10:
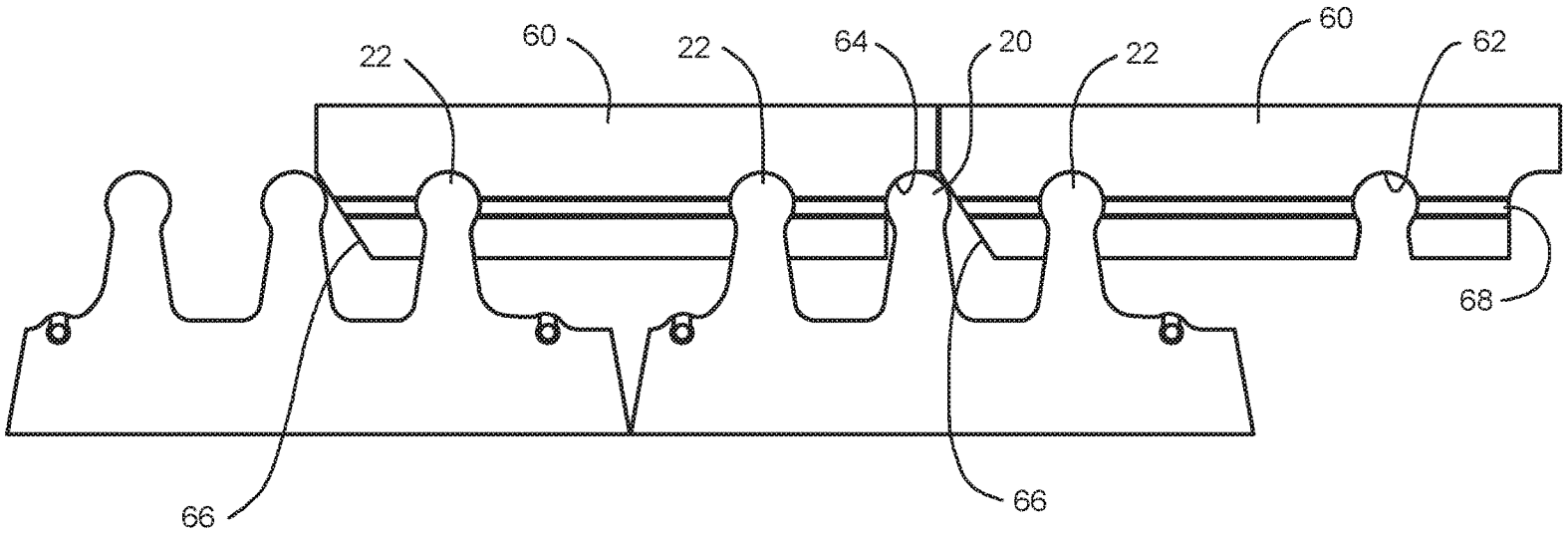
FIG. 10 is a top view of a parapet wall created with the parapet wall block of FIG. 9 and the retaining wall block of the present invention.

Referring to FIG. 10, a top view of one course of a parapet wall built with retaining wall blocks 10 and parapet wall blocks 60 is shown. As can be seen, parapet wall block 60 has less depth than retaining wall block 10, which when used in conjunction with each other allows the construction of narrower freestanding walls or fences. Rearward extending legs 20 and 22 of retaining wall blocks 10 fit into recesses 62 of parapet wall blocks 60. Where two parapet wall blocks meet and are adjacent to each other, tapered side surface 66 and curved side surface 64 combine to create a recess for center leg of 20 of retaining wall block 10. Recesses 62 are spaced appropriately in parapet wall block 60 to correspond to the location of side legs 22 from adjacent retaining wall blocks 10, which as discussed above in reference to FIGS. 1 and 5, is a distance equal to "c" or "a+b."

Figure 11:
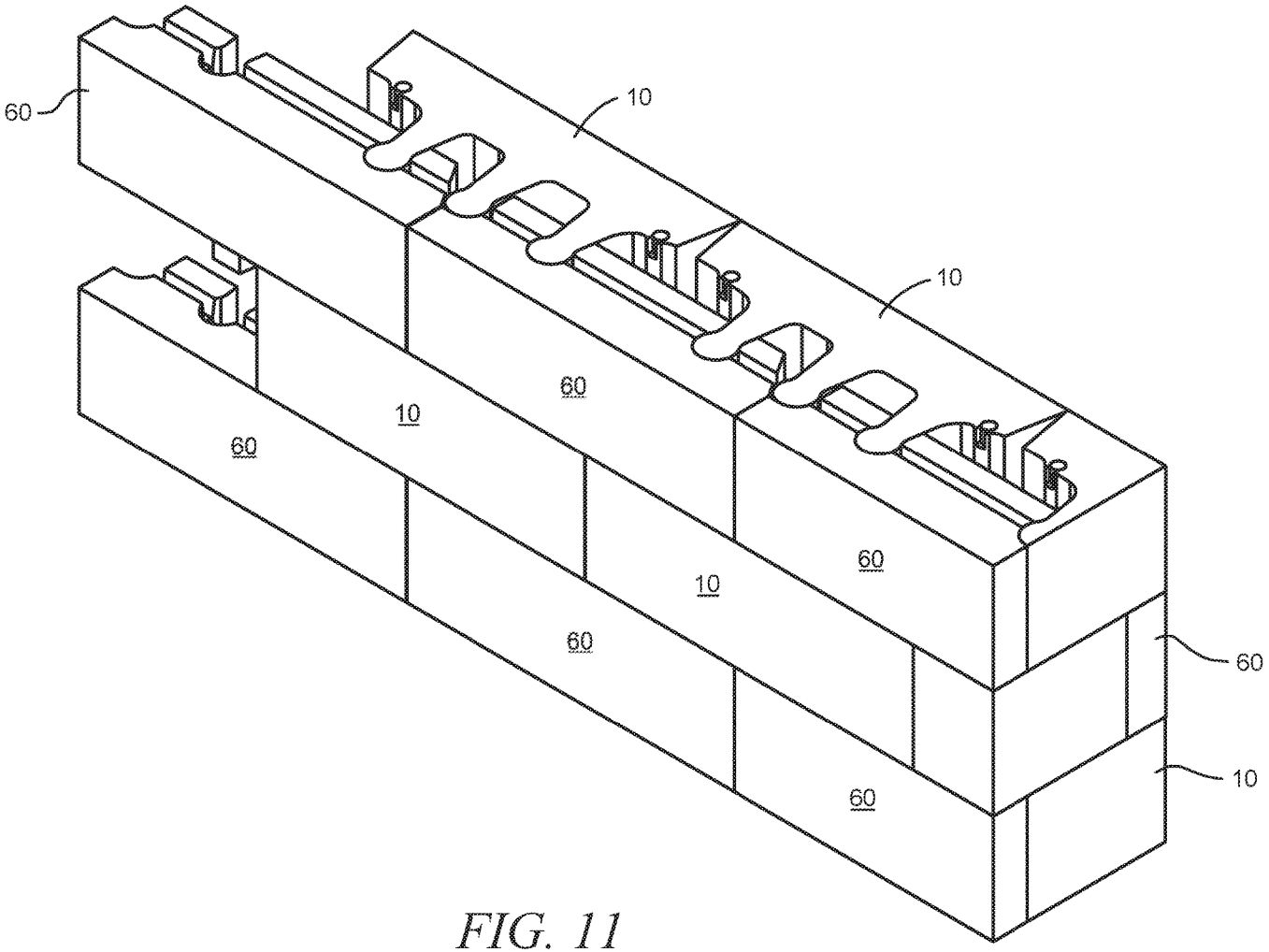
FIG. 11 is a perspective view of a parapet wall created with the parapet wall block of FIG. 9 and the retaining wall block of the present invention.

Referring to FIG. 11, a parapet wall constructed from retaining wall blocks 10 and parapet wall blocks 60 is shown. Each course of a parapet wall should alternate which side has parapet wall blocks 60 and retaining wall blocks 10. In this example, the lowest course has parapet wall blocks 60 on the near side of the wall and retaining wall blocks 10 on the far side. The middle course is opposite—retaining wall blocks 10 are on the near side and parapet wall blocks 60 are on the far side. This allows for increased stability and interlocking of the blocks as will be discussed regarding FIG. 12.

Figure 12:
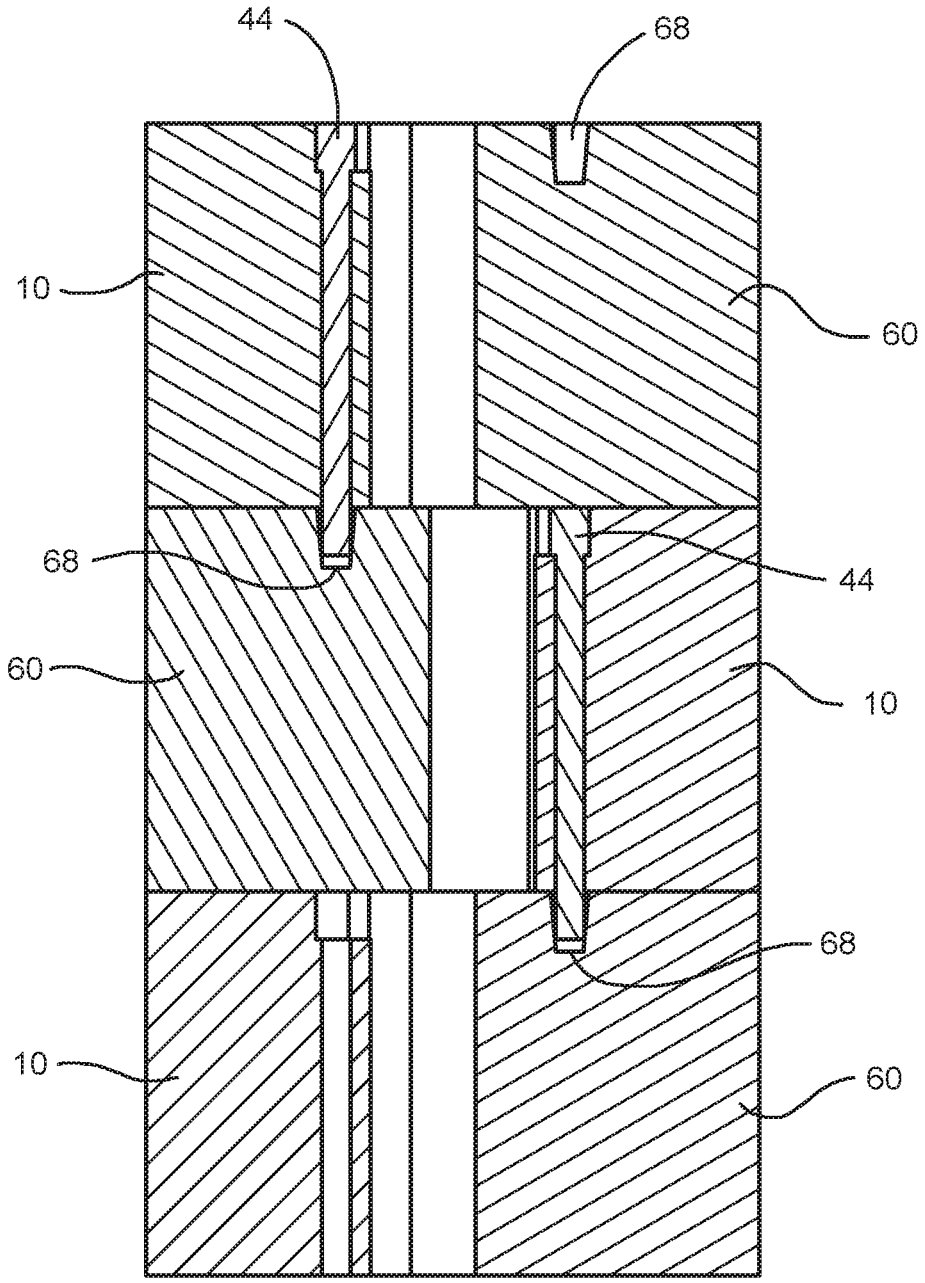
FIG. 12 is a side view of a parapet wall created with the parapet wall block of FIG. 9 and the retaining wall block of the present invention.

Referring to FIG. 12, a side view of a parapet wall constructed from retaining wall blocks 10 and parapet wall blocks 60 is shown. The lowest course of the wall has retaining wall block 10 on the left side and parapet wall block 60 on the right side. The blocks in the second course have been reversed, and parapet wall block 60 is on the left side with retaining wall block 10 on the right side. Pin 44 is seated in bore hole of retaining wall block 10 in the middle course with the portion of pin 44 that extends below bottom of retaining wall block 10 seated into channel 68 of parapet wall block 60 in the lowest course. Pin 44 locks retaining wall block 10 from the middle course to parapet wall block 60 of the lowest course and keeps retaining wall block 10 in vertical alignment with the front face of parapet wall block 60 below. And because parapet wall block 60 of the middle course is interlocked via its recesses with the legs of retaining wall block 10 of the middle course (as shown in FIG. 10), parapet wall block 60 also stays in alignment with the front face of retaining wall block 10 from the course below. As courses are added to the wall, the pins 44 lock or tie the blocks to the course below and the legs in conjunction with the recesses keep the blocks on the same course in alignment. In addition to allowing dry stack with pins (as shown), the blocks can be locked into place with adhesives, core filling, steel reinforcement core filling, post tensioning systems, or a combination of these installation methods could be used in constructing the wall depending on engineering specifications. Additionally, the two block parapet wall design affords the ability to change colors, textures, and designs to the faces of the free standing wall or fence. For example, the wall could be constructed with a different color and texture on the inside of the wall versus the outside of the wall, as the two units combine to build a single width wall.

Figure 13:
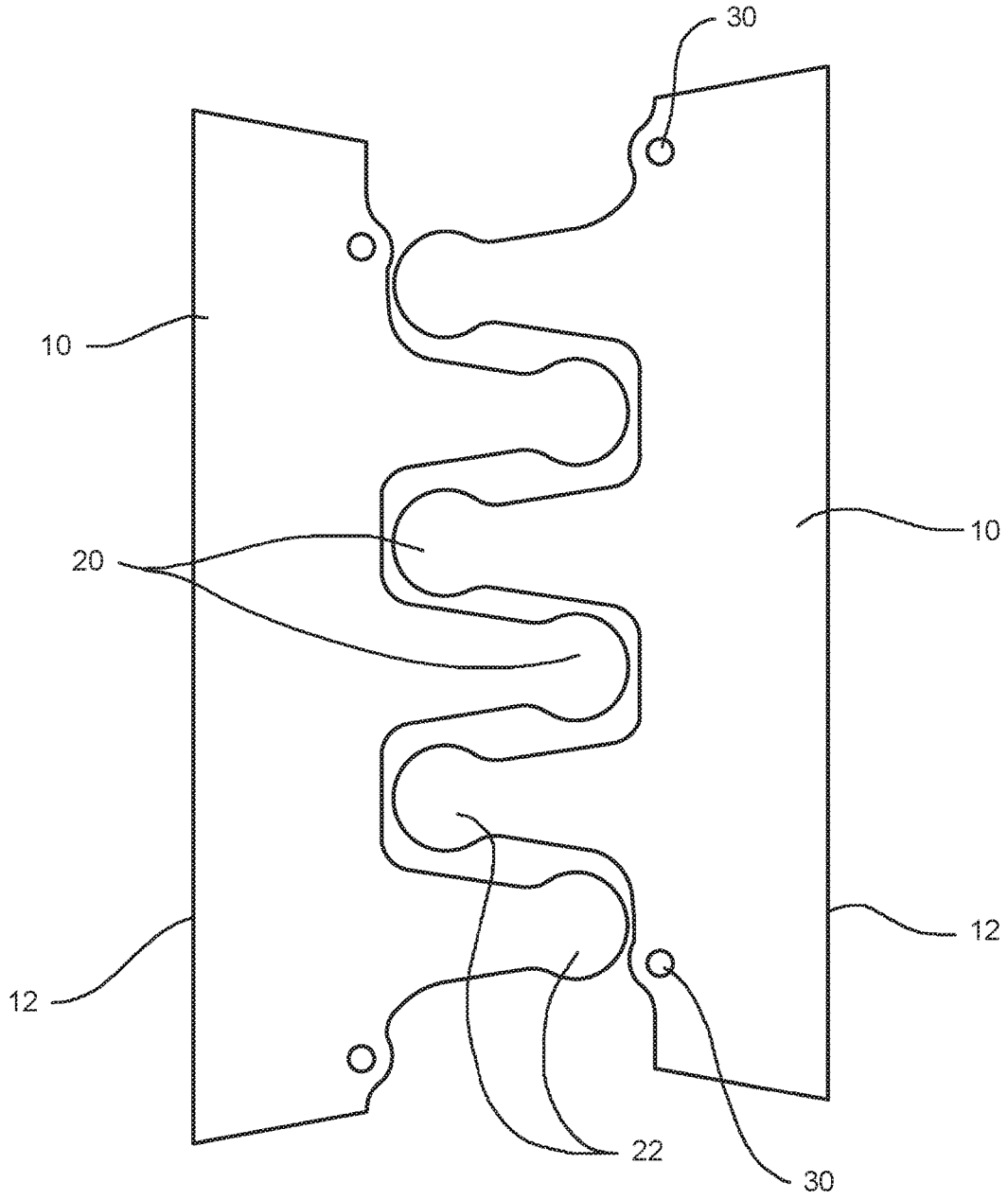
FIG. 13 is a top view of the manufacturing mold layout of the retaining wall block of the present invention.

Referring to FIG. 13, the layout of how two retaining wall blocks 10 can be made in one mold cavity. Because legs 20 and 22 are offset from the center of face 12 of block 10, the blocks can effectively mate together while maintaining similar edge terminations, which allows two blocks to be made at once. If the legs were symmetrically spaced from the center of the block, then to nest the legs together as shown in FIG. 13, the edges of the blocks would not be as close in alignment as is possible with the offset legs of the present invention. Being able to make two blocks with one mold increases production efficiency and also allows the space on shipping pallets to be packed more efficiently.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

The invention claimed is:

1. A retaining wall block comprising:

a forward portion comprising a top side, bottom side, two opposed sides, a face and a rear side both occupying an area between the top side, bottom side and two opposed sides;

first and second side support legs extending from the rear side of the forward portion in a direction opposite the face, wherein the first side support leg extends in a same direction as the second side support leg; and a center support leg extending between the first and second side support legs from the rear side of the forward portion in a direction opposite the face;

wherein the first and second side support legs and the center support leg are positioned such that, when a wall is formed from multiple courses of the retaining wall block offset from course to course by one half of a length of the face, a side support leg of a retaining wall block in an upper course of blocks aligns vertically with a side support leg of a retaining wall block in a lower course of blocks adjacent the upper course of blocks, while the center support leg of the retaining wall block in the upper course of blocks does not align vertically with the center support leg of the retaining wall block in the lower course of blocks.

2. The retaining wall block of claim 1 wherein the first and second side support legs and the center support leg taper along their length and terminate in a cylindrical shape.

3. The retaining wall block of claim 1 further comprising:

at least one pin-receiving bore hole extending from the top side through at least a portion of the forward portion; and at least one pin-receiving channel located on the bottom side;

wherein when the wall is formed, a retaining pin placed inside the pin-receiving bore hole extends upward from the top side of the retaining wall block in the lower course of blocks and into the at least one pin-receiving channel of the retaining wall block in the upper course of blocks.

4. The retaining wall block of claim 1 further comprising:

at least one pin-receiving bore hole extending from the top side through the forward portion to the bottom side wherein the at least one pin-receiving bore hole comprises an opening on the top side that tapers to an opening on the bottom side, wherein the opening on the bottom side is smaller in diameter than the top side; and wherein when the wall is formed, a retaining pin placed inside the at least pin-receiving bore hole extends downward from the bottom side of the retaining wall block in the upper course of blocks and is adjacent to the rear side of the forward portion of the retaining wall block in the lower course of blocks.

5. The retaining wall block of claim 1 further comprising:

at least one pin-receiving bore hole extending from the top side through the forward portion to the bottom side wherein the at least one pin-receiving bore hole comprises an opening on the top side and an opening on the bottom side, wherein the pin-receiving bore hole is tapered such that the opening on the bottom side is smaller in diameter than the opening on the top side; and further wherein when the wall is formed, a retaining pin placed inside the at least one pin-receiving bore hole extends downward from the bottom side of the retaining wall block in the upper course of blocks and extends into the opening on the top side of the retaining wall block in the lower course of blocks.

6. The retaining wall block of claim 1 wherein the center support leg is not positioned equidistant from the two opposed sides of the retaining wall block.

7. The retaining wall block of claim 1, further comprising a first leveling pad, a second leveling pad, and a third leveling pad extending from the bottom side of the retaining wall block, wherein the first leveling pad, the second leveling pad, and the third leveling pad are disposed between the upper course of blocks and lower course of blocks.

8. The retaining wall block of claim 7 wherein the first leveling pad of the first side support leg is disposed on a surface of the bottom side of the retaining wall block, the second leveling pad of the second side support leg is disposed on the terminating cylindrical end of the second side support leg, and the forward portion comprises the third leveling pad of the second side support leg disposed colinearly with the second leveling pad disposed on the second side support leg apart from the rear side of the forward portion.

9. A retaining wall comprising:

a plurality of courses of retaining wall blocks with each retaining wall block comprising a forward portion comprising a top side, bottom side, two opposed sides, a face and a rear side both occupying an area between the top side, bottom side and two opposed sides;

first and second side support legs extending from the rear side of the forward portion in a direction opposite the face, wherein the first side support leg extends in a same direction as the second side support leg; and a center support leg extending from the rear side of the forward portion in a direction opposite the face;

wherein the first and second side support legs and the center support leg are positioned such that, when the retaining wall is formed from the plurality of courses of retaining wall blocks offset from course to course of respective retaining wall blocks, by one half of a length of the face, a side support leg of a retaining wall block in an upper course of blocks aligns vertically with a side support leg of a retaining wall block in a lower course of blocks adjacent the upper course of blocks while the center support leg of the retaining wall block in the upper course does not align vertically with the center support leg of the retaining wall block in the lower course.

10. A parapet fence wall comprising:

a plurality of courses of retaining wall blocks and parapet wall blocks;

each retaining wall block, of the retaining wall blocks, comprising a forward portion comprising a top side, bottom side, two opposed sides;

a face and a rear side both occupying an area between the top side, bottom side and two opposed sides;

first and second side support legs extending from the rear side of the forward portion in a direction opposite the face, each of the first and second side support legs comprising a tapered leg portion and a cylindrical terminating portion, wherein the tapered leg portion is tapered along its length from a first end at the rear side of the forward portion to a second end at the cylindrical terminating portion, and further wherein a diameter of the cylindrical terminating portion is greater than a width of the second end of the tapered leg portion; and a center support leg extending from the rear side of the forward portion in a direction opposite the face;

each parapet wall block comprising a body comprising a top side, bottom side, two opposed sides, a face and a rear side both occupying an area between the top side, bottom side and two opposed sides, with the rear side further comprising a plurality of recesses;

wherein each recesses on the rear side of a parapet wall block comprises a cylindrical recess portion dimensioned to accept the cylindrical terminating portion of one of the side support legs, and a tapered recess portion to accept at least the second end of the tapered portion of one of the side support legs of a retaining wall block such that when a support leg of a first retaining wall block is positioned within a recess of a first parapet wall block, the first retaining wall block and the first parapet wall block are interlocked.

11. The parapet fence wall of claim 10, wherein the rear sides of the retaining wall blocks in a course of the parapet wall are positioned facing the rear sides of the parapet wall blocks in the same course of the parapet wall such that, when a fence wall is formed each course comprises a retaining wall block on one side with the face positioned outward in a first direction and a parapet wall block on the other side with face positioned outward in a second direction opposite the first direction.

* * * * *